United States Patent [19]

Lawson

[11] 3,937,403

[45] Feb. 10, 1976

[54] ELECTRICAL TERMINALS FOR FLAT WIRE

[75] Inventor: Gustaf Rudolph Lawson, Willingboro, N.J.

[73] Assignee: AMP Incorporated, Harrisburg, Pa.

[22] Filed: June 3, 1974

[21] Appl. No.: 475,708

Related U.S. Application Data

[63] Continuation-in-part of Ser. No. 404,086, Oct. 5, 1973, abandoned.

[52] U.S. Cl. ..... 339/97 C; 339/276 T

[51] Int. Cl.[2] ..... H01R 11/20

[58] Field of Search ..... 339/95, 97–99, 339/276

[56] References Cited

UNITED STATES PATENTS

| | | | |
|---|---|---|---|
| 2,715,764 | 8/1955 | Pierce | 339/276 SF |
| 2,748,452 | 6/1956 | Pierce | 339/276 SF |
| 2,802,195 | 8/1957 | Martines | 339/97 C |
| 3,455,022 | 7/1969 | Schmitz, Jr. | 339/276 SF |
| 3,496,520 | 2/1970 | Reynolds | 339/97 C |
| 3,728,473 | 4/1973 | Kuo | 339/97 C |
| 3,798,347 | 3/1974 | Harding et al. | 339/97 C |

*Primary Examiner*—Joseph H. McGlynn
*Attorney, Agent, or Firm*—William J. Keating; Jay L. Seitchik; Frederick W. Raring

[57] ABSTRACT

A terminal capable of being secured to a flat wire to make electrical contact with the conductor in the wire. The terminal is secured to the wire by pressing the wire between adjacent parts of the terminal so that electrically conductive barbs on the terminal pierce the insulation on the wire to contact the conductor.

A pair of terminals capable of being secured to a flat wire having two spaced conductors so that each terminal in the pair makes electrical contact with one of the conductors in the wire. The terminals are coupled to each other by a weakened portion. While coupled, the terminals define a generally U-shaped member so that the wire can be confined between the legs of the U while it is being secured to each of the terminals. The terminals are secured to the wire by pressing it between adjacent parts of each terminal so that electrically conductive barbs on each terminal pierce the insulation on the wire to contact their respective conductors. The terminals are separated from each other at the weakened portion.

5 Claims, 10 Drawing Figures

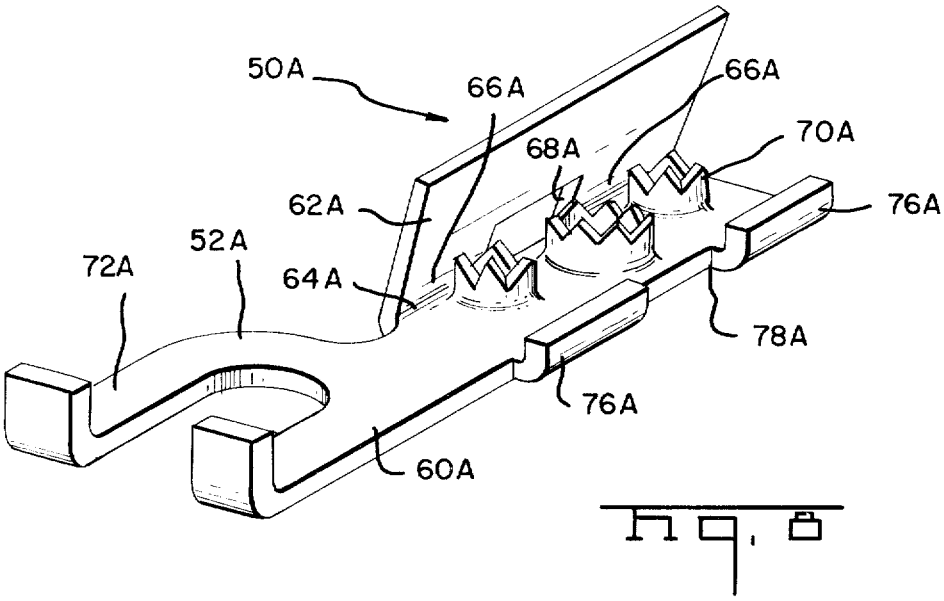
Fig. 8
Fig. 9
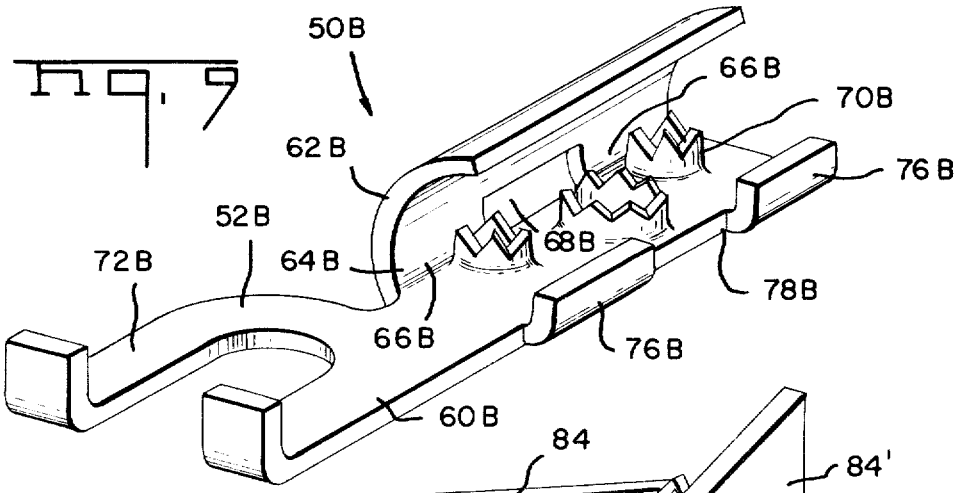
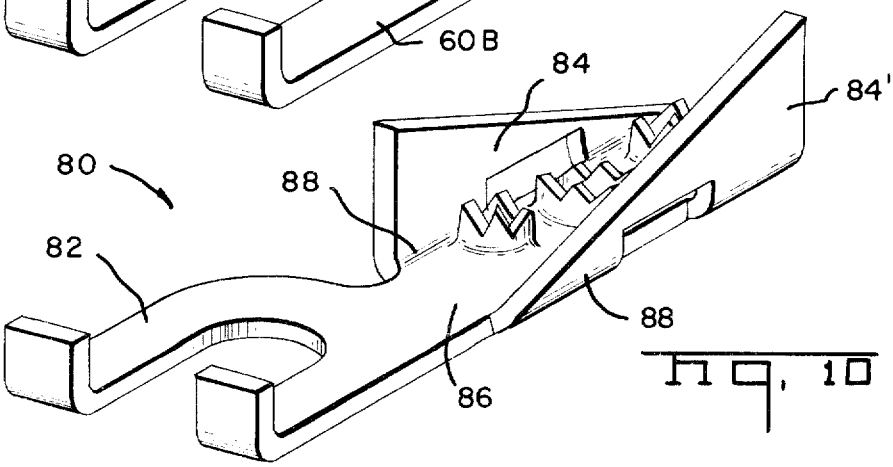
Fig. 10

ELECTRICAL TERMINALS FOR FLAT WIRE

RELATED PATENT APPLICATIONS

This patent application is a continuation-in-part of U.S. patent application Ser. No. 404,086 filed Oct. 5, 1973, in the name of Gustaf Rudolph Lawson, now abandoned.

BACKGROUND OF THE INVENTION

1. Field of the Invention

This invention relates to terminals and more specifically to terminals which are insulation-piercing and capable of being secured to flat, one or two-conductor lead-in wires, such as those utilized to connect a television receiver and an antenna, and to the conductor therein. Such wires are characterized by a relatively flat layer of insulation of predetermined width with the conductors disposed therein.

2. Description of the Prior Art

It has generally been found that the best and most reliable means of terminating an antenna wire has heretofore been through the use of automated machinery at the manufacturing stage. This means has initially required the removal of a portion of the flat insulating material between the conductors which are located within the marginal portions of the wire. After the insulation is stripped from the end of each remaining marginal portion of the wire to expose the conductor therein, a ring or spade terminal is secured to each exposed conductor.

It is often found, however, that the television owner needs to make a termination himself if, for example, the pre-installed terminal fails, the wire needs to be replaced or shortened, or additional receivers are placed on the same antenna. The means of termination described hereinabove, besides requiring several preparatory steps, is not well suited for use on location should the need arise. Removing and stripping the insulation from these wires without special tools is usually very difficult because the conductors comprise gathered strands of fine wire which can be easily damaged. To properly solder or crimp a terminal to the exposed conductor also requires special tools which the owner may not have.

It is, therefore, not infrequent that an owner will use a knife to remove the insulation but, in so doing, will accidentally cut the conductor and have to begin again. When the insulation is eventually removed, he will simply wrap the conductors around the respective receiving screws on the television receiver which are then tightened down directly on the conductors. However, since the wire is not supported, repeated movement of the receiver or the wire eventually causes one or both exposed conductors to fail to require the whole procedure to be repeated.

OBJECTS OF THE INVENTION

It is, therefore, an object to provide an insulation-piercing termination device for a flat, one or two-conductor, lead-in wire.

It is another object to provide a termination device of the type described which can be easily installed with the use of a pair of pliers or the like while insuring proper electrical contact with the conductors.

It is a further object to provide a termination device of the type described which can be secured directly to the wire to provide strain relief to limit the possibility of conductor failure without stripping the insulation of the wire.

It is still a further object to provide a termination device of the type described which has a configuration which allows the terminated conductors to be spaced-apart for independent electrical connection to a receiver.

BRIEF DESCRIPTION OF THE DRAWINGS

FIG. 8 is a perspective view of another form of the invention illustrated in FIG. 7.

FIG. 9 is a perspective view of still another form of the invention illustrated in FIG. 7.

FIG. 10 is a perspective view of still another preferred embodiment of the invention.

DETAILED DESCRIPTION OF THE EMBODIMENTS

Figure 1:
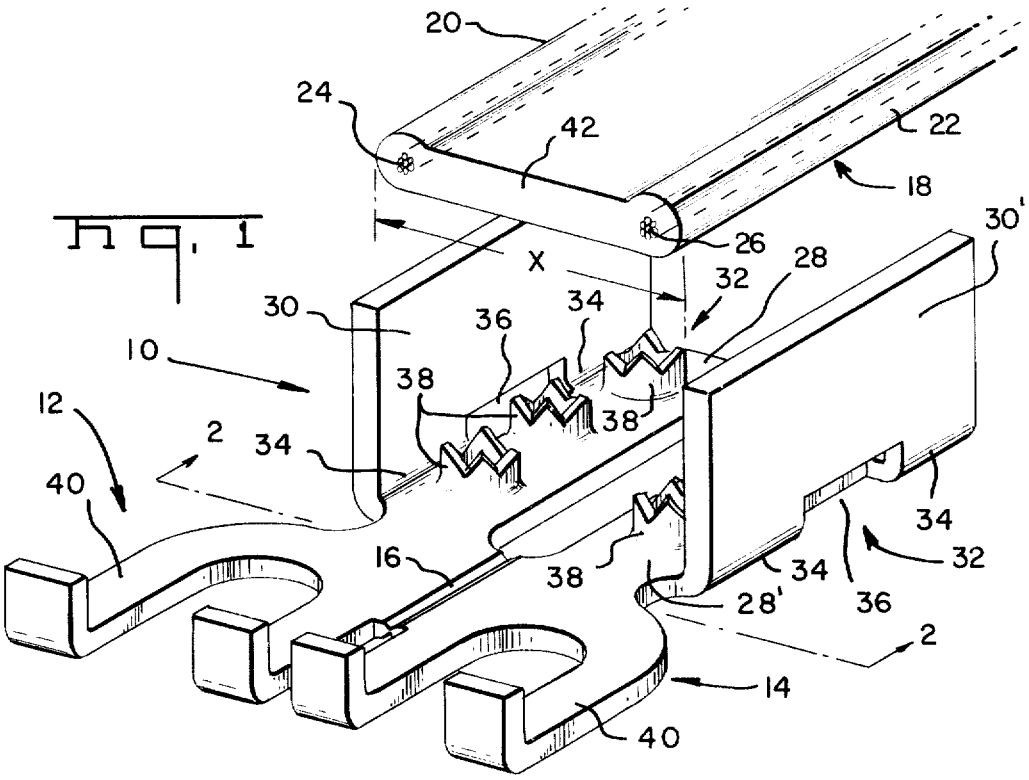
FIG. 1 is a perspective view of one presently preferred embodiment of the invention including the two-conductor wire to which it is capable of being secured.

As shown in FIG. 1, one preferred embodiment of the invention, in the form of a termination device 10, generally includes a pair of terminals 12, 14 rigidly joined by a pre-weakened section 16 therebetween. The preferred device 10 is stamped and formed from electrically conductive sheet metal to be capable of receiving and being secured to, a flat, insulated, two-conductor lead-in wire 18. The wire 18 comprises a layer of insulation of a predetermined width X and includes marginal portions 20, 22 which respectively include therein the conductors 24, 26.

Each terminal 12, 14, respectively includes a plate-like members 28, 28' which are each joined to a second plate-like member 30, 31' by a deformable hinge 32 therebetween. A description of the terminal 12 will be equally applicable for the terminal 14. In the preferred device 10, the members 28, 30 of the terminal 12 extend generally perpendicularly with respect to each other and the hinge 32 includes two portions 34 with an opening 36 therebetween. The arrangement of the portions 34 and opening 36 in this embodiment is such that an outside force applied to the members 28, 30 causing them to move together will result in deformation which will generally be confined to the hinge 32 because of its smaller cross-sectional area.

To provide the insulation-piercing feature of the preferred device 10, the member 28 includes an array of conductive elements such as barbs 38 projecting from its surface generally toward the member 30. Significant features of the array of barbs 38 will be discussed in detail hereinbelow.

Extending co-planarly from each member 28, 28' is a spade-type connecting portion 40 which portions 40 are joined by the pre-weakened section 16 so that the entire device 10 has a rigid configuration prior to deformation of the hinges 32.

When applying the device 10 to the wire 18, the wire 18 is cut to provide an end 42. The end 42 is aligned with the device 10 so that the wire 18 generally overlies the members 28, 28' without extending over the connecting portions 40 as shown in FIG. 1. The wire 18 is then positioned laterally between the hinges 32 and placed against the barbs 38 as generally shown at the right in FIG. 2.

It should be observed that the center barb in each set of barbs may be set relatively close to its respective hinge. This will insure the center barb will contact the conductor if the wire is not centrally located on the terminal. Thus, in addition to weakening the hinge, gap 36 also enables the center barb to be formed near the hinge without interferring with plate-like member 30.

The distance between the hinges, shown at Y, is slightly larger than the width X of the wire 18. As a result, the wire 18 is retained within the device 10 with its lateral movement restricted by the generally U-shaped cross-section of the device 10 as formed by members 28, 28', 30, 30' and the hinges 32.

Figure 2:
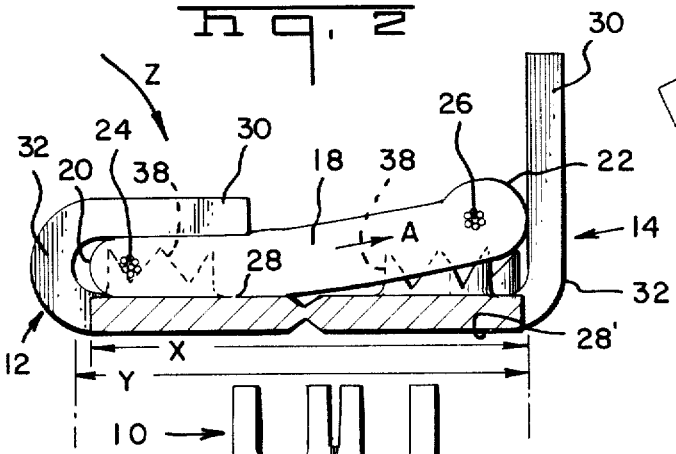
FIG. 2 is a view of the embodiment shown in FIG. 1 as seen along line 2-2 with one terminal connected to its corresponding conductor.

There are several reasons for restricting the lateral movement of the wire 18 with respect to the device 10. As shown in FIG. 2, it is through the deformation of the hinge 32 that the terminal 12 is secured to the wire 18 and its barbs 38 make electrical contact with its respective conductor 24. The deformation is caused by forcing the members 30 and 28 together, such as through the use of a pair of pliers (not shown). The member 30 is angularly displaced along the general path indicated at Z, and the wire 18 is forced in a direction A. If it were not restricted by the terminal 14 or a similar, rigid alignment element providing this function, it would be moved from its desired location between the members 28, 30. The wire 18 must be maintained between the members 28, 30 until the hinge 32 is sufficiently deformed to cause the members 28, 30 to resiliently grip the wire therebetween.

Furthermore, failure to retain the wire against unrestricted movement in the direction A would allow the conductor 24 to move sufficiently from alignment with the array of barbs 38 so that even if the wire were secured between the members 28, 30, proper electrical contact with the conductor 24 would not be assured. The array of barbs 38 is designed to insure proper contact with the conductor 24 if it is maintained by an alignment element within a limited range of lateral positions during deformation of the hinge 32. Within this limited range, the insulation of the wire 18 will be pierced by the barbs 38 until the conductor 24 makes initial contact with one of the barbs 38. The conductor 24 then is capable of general lateral movement with respect to this initial barb 38 as the entire array further penetrates the wire. Consequently, the conductor 24 tends to follow the path of least resistance and seeks a final position between laterally adjacent barbs 38. The barbs 38 have a height, shape and lateral dispersement, as shown in FIG. 2, to provide multi-contact with the conductor 24 so positioned therebetween without causing damage to the conductor 24 during the penetration which would interfere with its conductive function. Further, the array of barbs relieve stresses at the terminal which could cause separation of the wire and the terminals during use.

With the terminal 12 secured to the wire 18, as shown in FIG. 2, it obviously serves as an alignment element for the terminal 14. However, it should be apparent that either of the terminals 12 or 14 could be first secured to the wire 18 as the other terminal 14 or 12 provides the alignment function.

Figure 3:
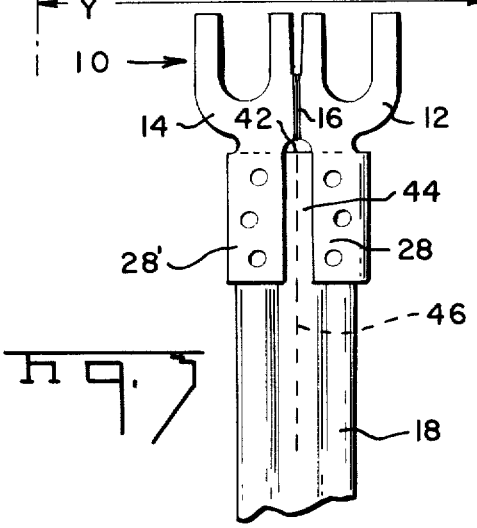
FIG. 3 is a plan view of the preferred embodiment as secured to the wire.

When the preferred device 10 is fully secured to the wire 18, as in FIG. 3, the terminals 12 and 14 are still mechanically and electrically joined by the pre-weakened section 16. With the section 16 positioned beyond the end 42 of the wire 18 and a gap 44 provided between the members 28, 28', the center 46 of the wire 18 is accessible to a knife or similar cutting device. Furthermore, when a knife is used to cut along the center 46 for eventual separation of the terminals, the gap 44 being defined by the members 28, 28' allows a good starting cut to protect against the accidental cutting of either conductor 24, 26.

Figure 4:
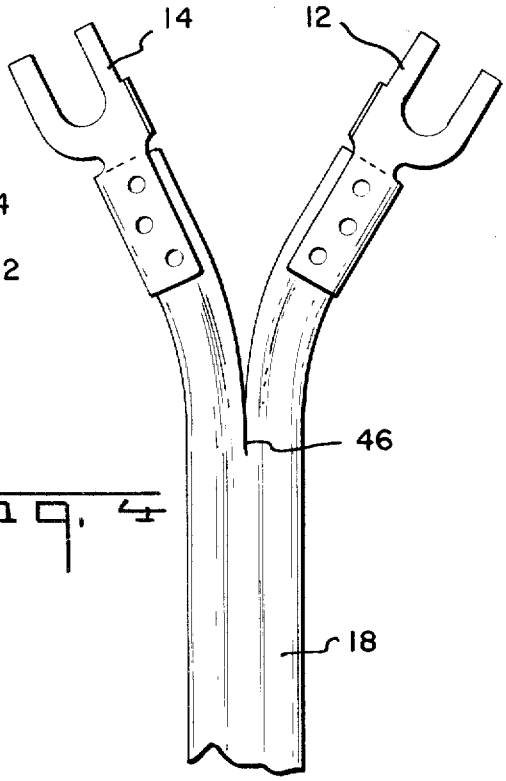
FIG. 4 is a plan view like that of FIG. 3 with the terminals separated.

As shown in FIG. 4, with the wire 18 cut along the center 46 a sufficient distance from the end 42, the wire 18 creates no resistance for the separation of the terminals 12, 14 by the intentional failure of the pre-weakened section 16. The electrically and mechanically separated terminals 12, 14 may then be spaced-apart as needed to be individually connected to their respective receiving screws.

It should further be noted that when the device is terminated to some types of wire as shown in FIG. 3, the insulation includes characteristics which cause it to be resiliently extruded into the gap 44. With the insulation so extruded, this type of wire offers no resistance to the separation of the terminals by the intentional failure of the pre-weakened section 16 prior to the wire being cut. With the terminals structurally separated first, the relaxation of the insulation allows the terminals to be sufficiently displaced to allow a pair of scissors to be directed to the gap 44 for cutting of the wire along the center 46. When the device is to be used with insulated wire of this type, the longitudinal location of the pre-weakened section with respect to wire, as described hereinabove, is not as significant since the intentional failure occurs before cutting.

Figure 5:
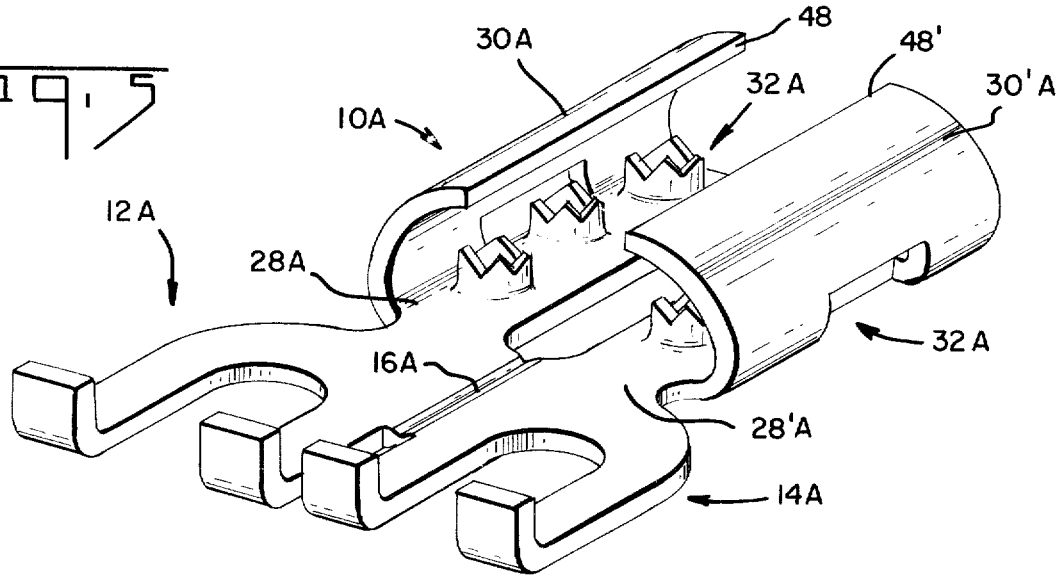
FIG. 5 is a perspective view of another form of the invention illustrated in FIG. 1.
Figure 6:
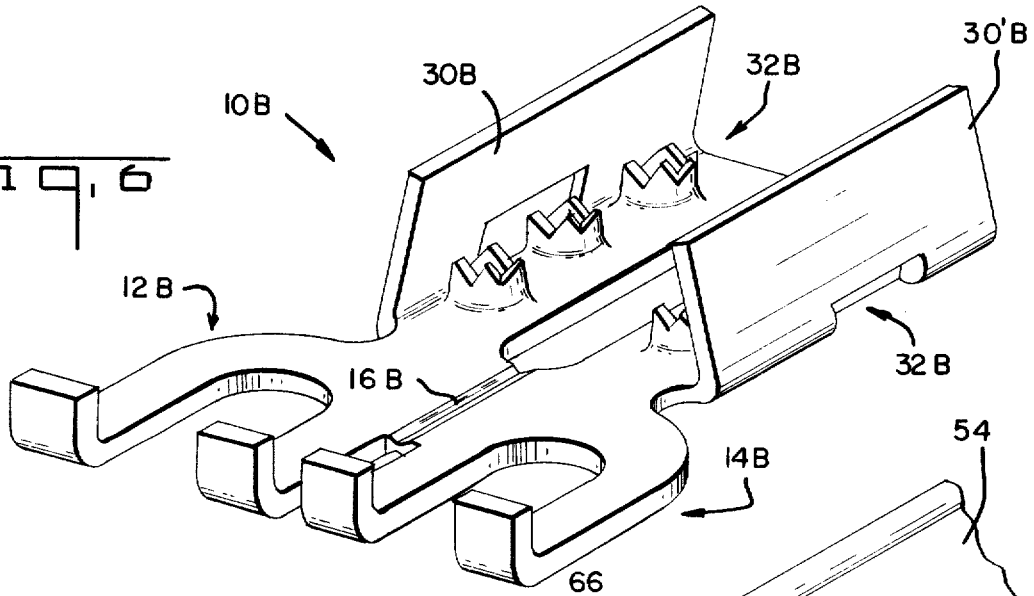
FIG. 6 is a perspective view of still another form of the invention illustrated in FIG. 1.
Figure 7:
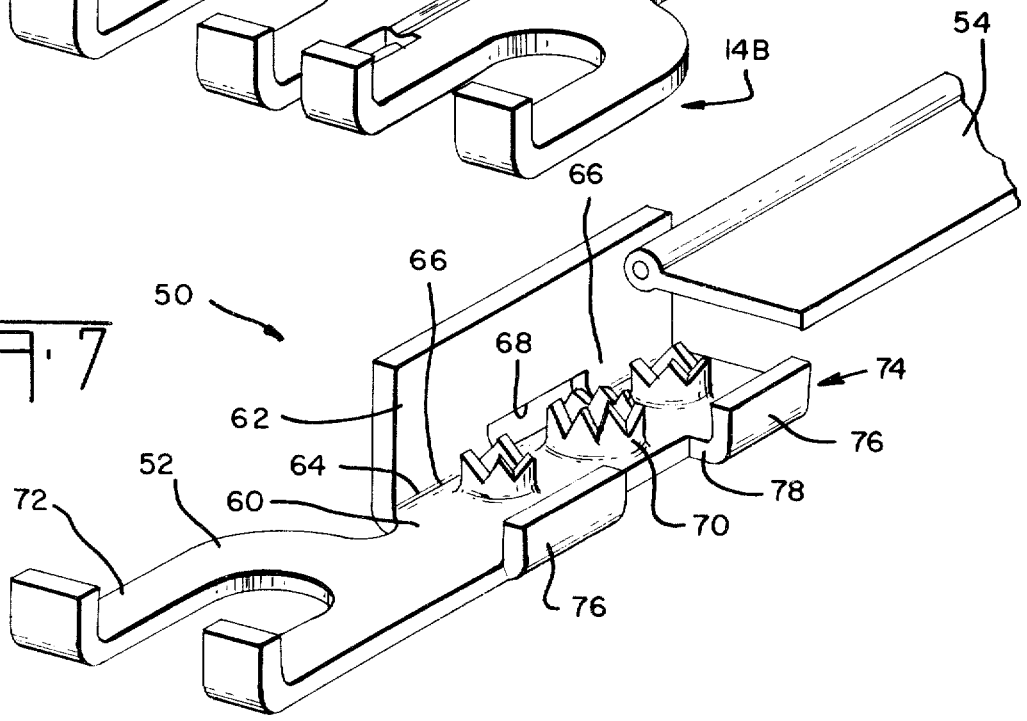
FIG. 7 is a perspective view of another preferred embodiment of the invention including a one conductor flat wire to which it is capable of being secured.

Referring to FIGS. 5 and 6, termination devices 10A and 10B are illustrated. These termination devices are virtually identical in every respect to termination device 10 illustrated in FIG. 1. Accordingly, those parts of termination devices 10A and 10B which are identical to corresponding parts of termination device 10 are identified by the same reference numeral as used in FIG. 1 followed by the letter A or B respectively.

In termination device 10A, plate-like members 30A and 30'A are curved so that their distal ends 48 and 48' overlie members 28 and 28'A. With this arrangement the plates 30A and 30'A surround the wire so that it is not only restrained against lateral movement, but it is also retained against separation from members 28A and 28'A. Further, the likelihood of crushing members 30A and 30'A as they are being secured to the wire is substantially less than the likelihood of crushing corresponding members 30 and 30' since the surface of each of members 30A and 30'A near their distal ends are substantially parallel to the surface of members 28A and 28'A.

In termination device 10B plate-like member 30B and 30'B are generally planar, but they form an acute angle with respect to members 28B and 28'B. This form of terminal has substantially the same advantages as the terminal 10B.

Termination devices 10A and 10B may be secured to the two-conductor flat wire in the same way that termination device 10 is secured thereto. Therefore, the description of the techniques for securing termination devices 10A and 10B to the wire will not be repeated.

Occasionally, it may be necessary to apply a terminal to a flat wire having a single conductor. Such occasions may arise if a two conductor flat wire has been cut along its length to provide two separate wire ends.

In this event, the terminals illustrated in FIGS. 1, 5 and 6 may be separated at their pre-weakened portions 16, 16A and 16B, and then only one of the terminals 12 or 14 need be used as desired. Using a single terminal broken from the pair may present some difficulty in aligning the conductor in the wire with the array of barbs 32 since there is no retaining means for aligning the wire therewith.

The embodiments of the invention illustrated in FIGS. 7–10 show single terminals that deal with this problem. Thus, referring to FIG. 7, a termination device 50, which includes one terminal 52 is illustrated. The device 50 may be stamped and formed from electrically conductive sheet metal in the manner described above so that it can receive and be secured to a flat, insulated one conductor lead-in wire 54 of predetermined width.

The terminal 52 includes plate-like members 60 and 62 which are joined to each other by a deformable hinge portion 64 disposed therebetween.

The members 60 and 62 may extend in generally perpendicular relation with respect to each other with a hinge portion 64 disposed therebetween.

The hinge is comprised of two members 66 with an opening 68 disposed therebetween. The opening 68 substantially reduces the amount of material at the hinge so that the deformation of the plate members is generally confined to the hinge area.

An array of conductive elements such as barbs 70 are disposed along one of the plate-like members 60 and 62 and extend generally toward the other member. The barbs have generally the same shape and the same configuration as barbs 38 discussed earlier. However, that barb configuration may not engage the conductor if the wire is not centered on the terminal. This may be avoided by giving the center barb a larger diameter than the outer barbs.

Extending in generally coplanar relation to one of the plate-like members 62 is a connecting portion 72 which is generally the same as connecting portion 40, described earlier.

In order to simplify the handling of the wire prior to the members being secured thereto, a retaining means 74 which comprises two elements 76 which may be separated by a gap 78 are provided along the edge of plate-like member 62 which is spaced from the hinge 64. Gap 78 enables the diameter of the center barb to be substantially the same as the distance between plate-like member 62 and retaining means 76.

As seen in the drawing, connecting portion 72 extends from member 62 in the same direction as hinge 64 so that when the edge of wire 54 lies along the hinge (FIG. 7) it is in alinement with connecting portion 72.

If preferred, the retaining means 74 may be a unitary elongated member. The retaining means 74 is substantially coextensive with the member 62 and extends generally perpendicularly above plate-like member 60 to a height which is about equal to the thickness of the flat wire 54 so that when plate-like member 62 is secured over the wire, the wire is confined thereby.

Referring to FIGS. 8 and 9, termination devices 50A and 50B are illustrated. These termination devices are virtually identical in every respect to termination device 50 illustrated in FIG. 7 and corresponding parts of termination devices 50A and 50B are identified by the same reference numeral as used in FIG. 7 followed by the letters A or B respectively.

In termination device 50A, plate-like members 60A and 62A are generally planar. They form an acute angle with respect to each other.

In termination device 50B, plate-like member 62B is curved so that its distal end overlies member 60B and the surface of member 62B near its distal end is substantially parallel to the surface of member 60B.

The advantage of having the plate-like members disposed at an acute angle with respect to each other or by having one of the plate-like members curved have been fully discussed above.

In FIG. 10, a termination device 80 comprising a terminal 82 is illustrated. This device is similar in many respect to the devices 50, 50A and 50B just described. In this device, plate-like member 84 and 84' are connected to plate-like member 86 by hinge portions 88 in a manner similar to that described above. Members 84 and 84' are generally shaped as complimentary right triangles. They are supported by the hinge portions in complimentary relation to each other so that when hinges 88 are deformed and they are folded over member 86 to secure the wire, they lie along side each other thereby enclosing the end of the wire and insuring electrical contact between the barbs and the conductor in the wire.

While there has been shown and described certain preferred embodiments of the invention, it will be obvious to those skilled in the art that changes and modifications may be made therein without departing therefrom. For example, if the pair of terminals were joined by a nonconductive section rather than the pre-weakened section, the connecting portions could be extended to a predetermined spaced-apart position corresponding to the relative positions of their respective receiving screws. The device could be secured to the wire and be completely serviceable without physically separating the terminals or cutting the wire. Accordingly, the scope of the invention should not be limited by the foregoing description, but, rather, only by the scope of the claims appended hereto.

I claim:

1. A pair of terminals capable of being secured to a television antenna wire or the like wherein said wire comprises a layer of substantially flat insulation of predetermined width having two spaced conductors therein so that each of said terminals is electrically connected to one of said conductors wherein, each of said terminals being substantially a mirror image of the other and comprising a pair of plate-like members, each of said pairs comprising first and second plate-like members, a deformable hinge disposed between said first and second members in each of said pairs for maintaining said members of each pair in fixed angular relation with respect to each other prior to deformation of said hinges, means for piercing the layer of insulation and contacting the conductors in the wire, said means comprising an array of insulation piercing, electrically conductive elements coupled to at least one of said members in each of said pairs and extending generally toward the other member in said pair, electrically conductive connecting means mechanically coupled to one of said members and said array of electrically conductive elements in each of said pairs for connection with external conductive members, means for releasably coupling said first and second pairs to each other so that said pairs define a generally U-shaped cross-section with one member in one of said pairs being coplanar with a corresponding member in the other pair, said members cooperating to form the base of said U and the other member in each of said pairs cooperating to form the legs of said U, the distance between said legs being slightly larger than the predetermined width of the wire, the two pairs of members thus cooperating to form a single locating area for receiving the antenna wire so that the wire can be received therebetween while its lateral movement is restricted thereby to maintain the conductors in alignment with their corresponding array of electrically conductive elements, said legs positioning said wire while the wire is pressed between said first and second members in each of said pairs and said arrays of electrically conductive elements pierce the layer of insulation comprising the wire to make electrical contact with their corresponding conductor while said terminals are coupled to each other.

2. A pair of terminals as defined in claim 1 wherein the adjacent edges of said member defining the base of said U are spaced from each other to define an access opening to enable a cutting member to be inserted therebetween to facilitate cutting said wire between the conductors therein prior to the separation of said terminals.

3. A pair of terminals as defined in claim 1 wherein said members in each pair that defines a leg of said U is at an acute angle with respect to the other member in that pair.

4. A pair of terminals as defined in claim 1 wherein said member in each pair that defines a leg of said U is curved so that the distal end of each curved member overlies the other member in that pair.

5. A pair of terminals as defined in claim 1 wherein said member in each pair that defines a leg of said U is substantially perpendicular to the other member in that pair.

* * * * *